US007780010B2

(12) United States Patent
Kinuhata

(10) Patent No.: US 7,780,010 B2
(45) Date of Patent: Aug. 24, 2010

(54) ELECTRONIC DEVICE PACKAGING APPARATUS

(75) Inventor: Yoshikage Kinuhata, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 12/576,432

(22) Filed: Oct. 9, 2009

(65) Prior Publication Data

US 2010/0096285 A1 Apr. 22, 2010

(30) Foreign Application Priority Data

Oct. 16, 2008 (JP) ..... 2008-266923

(51) Int. Cl.
*B65D 81/02* (2006.01)
*B65D 85/30* (2006.01)

(52) U.S. Cl. ..... 206/722; 206/485; 206/590; 53/462

(58) Field of Classification Search ..... 206/588, 206/590, 591, 592, 594, 485, 701, 722, 723; 53/452, 462, 170

See application file for complete search history.

(56) References Cited

U.S. PATENT DOCUMENTS 3,192,680 A * 7/1965 Mantell et al. ..... 53/449
3,837,479 A * 9/1974 Lehmann ..... 206/489
7,278,249 B2 * 10/2007 Kari ..... 53/397

FOREIGN PATENT DOCUMENTS

JP 2000-344275 A 12/2000

* cited by examiner

*Primary Examiner*—Jacob K Ackun, Jr.
(74) *Attorney, Agent, or Firm*—Global IP Counselors, LLP

(57) ABSTRACT

An electronic device packaging apparatus for packaging an electronic device includes a box and a cushioning member. The cushioning member is integrally formed as a one-piece, unitary member and disposed within the box. The cushioning member includes a central shelf component and a pair of leg components. Each of the leg components has an outer leg component and an inner leg component. The inner leg component with a through hole extends between the outer leg component and the central shelf component. Inner side faces of the outer leg components contact with upper edge portions of the electronic device, respectively.

13 Claims, 5 Drawing Sheets

ELECTRONIC DEVICE PACKAGING APPARATUS

CROSS-REFERENCE TO RELATED APPLICATIONS

This application claims priority to Japanese Patent Application No. 2008-266923, filed on Oct. 16, 2008. The entire disclosure of Japanese Patent Application No. 2008-266923 is hereby incorporated herein by reference.

BACKGROUND OF THE INVENTION

1. Field of the Invention

The present invention generally relates to an electronic device packaging apparatus. More specifically, the present invention relates to an electronic device packaging apparatus for packaging set-top boxes and other such electronic devices.

2. Background Information

A set-top box or other such electronic device is packaged in a cardboard box via upper and lower cardboard cushioning materials. The electronic device is foamed in a rectangular box shape, and a power cord is connected to the electronic device. The electronic device with the power cord is sealed inside an airtight plastic film bag.

The cardboard box has a box main body that is substantially square in plan view, and a total of eight flaps (four upper and four lower) that extend integrally from upper and lower opening edges of the box main body.

The lower cushioning material has a bottom piece and a pair of side pieces. The bottom piece is inserted into the box main body and placed on the lower flaps. The side pieces are substantially U-shaped in lateral cross section, are provided integrally extending from side edges of the bottom piece, and rise up along inner side faces of the box main body.

The upper cushioning material has a divider piece and a pair of end pieces. The divider piece is inserted into the lower cushioning material and is parallel to the bottom piece. The end pieces are substantially U-shaped in lateral cross section, are provided integrally extending from end edges of the divider piece, and hang down along the inner end faces of the box main body.

The assembly procedure will now be described. A lower opening of the box main body is closed with the lower flaps, and the upper flaps are spread upward to open up an upper opening of the box main body. In this state, the lower cushioning material is inserted into the box main body. Then, the electronic device is placed on the bottom piece of the lower cushioning material. Furthermore, the upper cushioning material is inserted into the lower cushioning material. An instruction booklet, a remote control, and so forth are placed on the divider piece of the upper cushioning material. Then, the upper opening of the box main body is closed with the upper flaps. Another electronic device packaging apparatus is also known (see Japanese Laid-Open Patent Application Publication No. 2000-344275, for example).

The electronic device is protected by the two cushioning materials, and using these two cushioning materials drives up the cost and also involves more work in packaging.

Furthermore, there is plenty of space above and to the sides of the electronic device packed in the box. Since the cushioning materials are elastically deformably interposed within the space, horizontal and downward impact forces that are exerted on the side and upper faces of the box can be cushioned, allowing the electronic device to be protected.

However, the bottom piece of the lower cushioning material is merely interposed between the lower flaps and the electronic device packed in the box. The bottom piece undergoes almost no elastic deformation in its thickness direction. Thus, the cushioning action is weak, and there is the risk that the electronic device will be damaged by an upward impact force exerted on a lower face of the box.

In view of the above, it will be apparent to those skilled in the art from this disclosure that there exists a need for an improved electronic device packaging apparatus. This invention addresses this need in the art as well as other needs, which will become apparent to those skilled in the art from this disclosure.

SUMMARY OF THE INVENTION

The present invention was conceived in light of the above-mentioned problems. One object of the present invention is to provide an electronic device packaging apparatus with which an electronic device can be effectively packaged with an inexpensive structure that affords proper cushioning action.

In accordance with one aspect of the present invention, an electronic device packaging apparatus for packaging an electronic device includes a box and a cushioning member. The cushioning member is integrally formed as a one-piece, unitary member and disposed within the box. The cushioning member includes a central shelf component and a pair of leg components. The central shelf component is configured to support the electronic device relative to the box at a spaced apart location above a bottom portion of the box. The leg components support the central shelf component relative to the box therebetween. Each of the leg components has an outer leg component and an inner leg component. The outer leg component is disposed on the bottom portion of the box and extends upward and inward of the box relative to respective one of side faces of the box. A lateral width of the outer leg components is larger than a depth of the box. The inner leg component with a through hole extends between the outer leg component to the central shelf component. A lateral width of the inner leg components is smaller than the lateral width of the outer leg components. The inner leg components suspend the central shelf component relative to the bottom portion of the box therebetween. Inner side faces of the outer leg components contact with upper edge portions of the electronic device, respectively, when the electronic device is placed on the central shelf component and the upper edge portions of the electronic device are disposed through the through holes of the inner leg components.

With the electronic device packaging apparatus of the present invention, it is possible to provide an electronic device packaging apparatus with which an electronic device can be effectively packaged with an inexpensive structure that affords proper cushioning action.

These and other objects, features, aspects and advantages of the present invention will become apparent to those skilled in the art from the following detailed descriptions, which, taken in conjunction with the annexed drawings, disclose a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENT

A preferred embodiment of the present invention will now be explained with reference to the drawings. It will be apparent to those skilled in the art from these disclosures that the following descriptions of the preferred embodiment of the present invention are provided for illustration only and not for the purpose of limiting the invention as defined by the appended claims and their equivalents.

As shown in FIGS. 1 to 4, an electronic device packaging apparatus includes a cardboard box 1 and a cushioning material (e.g., cushioning member or cardboard) 7. An electronic device 4, such as a set-top box or other such electronic device, is packaged in the box 1 via the cushioning material 7. The electronic device 4 is formed in a rectangular box shape, and a power cord 4*a* is connected to the electronic device 4. The electronic device 4 with the power cord 4*a* is sealed inside an airtight plastic film bag (not shown).

The box 1 includes a box main body 1*a* and a total of eight flaps 1*b* and 1*c* (four upper flaps 1*b* and four lower flaps 1*c*). The box main body 1*a* is substantially square in plan view. The upper and lower flaps 1*b* and 1*c* extend integrally from upper and lower opening edges of the box main body 1*a*.

Figure 2:
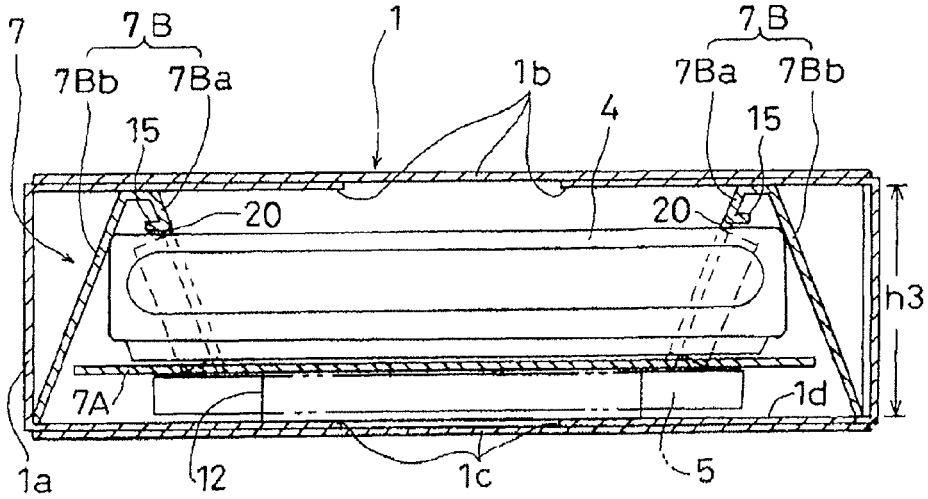
FIG. 2 is a cross sectional view of the electronic device packaging apparatus taken along II-II line in FIG. 1.
Figure 5:
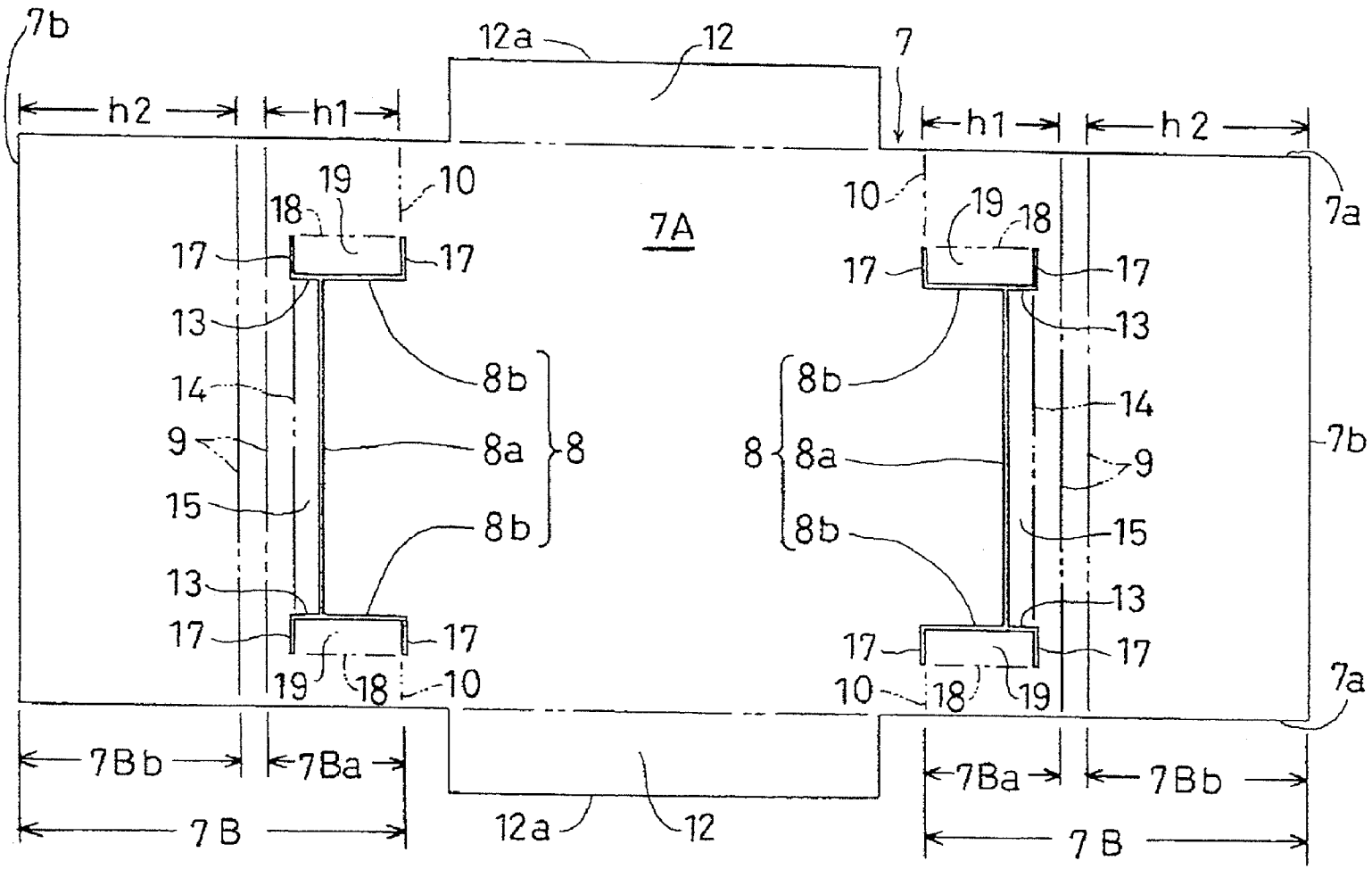
FIG. 5 is a development view of a cushioning material of the electronic device packaging apparatus illustrated in FIG. 1.

As shown in FIG. 5, the cushioning material 7 is made of a single sheet of cardboard that is substantially rectangular. A pair of substantially U-shaped cut-outs 8 is formed on the cushioning material 7. Each of the cut-outs 8 includes a longitudinal slit 8*a* extending perpendicular to a lengthwise direction (or lateral direction) of the cushioning material 7 near each of end portions of the cushioning material 7, and a pair of lateral slits 8*b* extending from ends of the longitudinal slits 8*a* toward the center of the cushioning material 7. As a result, the cushioning material 7 is divided into a central shelf component 7A and a pair of leg components 7B. A pair of outside fold lines (e.g., outside fold portions) 9 that is parallel to each of the longitudinal slits 8*a* is formed in the middle of each of the leg components 7B. Furthermore, four inside fold lines (e.g., inside fold portions) 10 are formed in between the distal ends of the lateral slits 8*b* and side edges 7*a* of the cushioning material 7. The inside fold lines 10 extend in a direction parallel to the longitudinal slits 8*a*. As a result, portions located between the inside fold lines 10 and the outside fold lines 9 serve as inner leg components 7Ba, and portions between the outside fold lines 9 and end edges (e.g., lateral side edges) 7*b* of the cushioning material 7 serve as outer leg components 7Bb. The lateral width h1 of the inner leg components 7Ba in the lateral direction of the cushioning material 7 is set smaller than the lateral width h2 of the outer leg components 7Bb (h1<h2). In other words, the lateral width h1 of the inner leg components 7Ba along the side edge 7*a* of the inner leg components 7Ba of the cushioning material 7 is smaller than the lateral width h2 of the outer leg components 7Bb along the side edges 7*a* of the outer leg components 7Bb of the cushioning material 7. The lateral width h2 of the outer leg components 7Bb is set greater than the depth h3 (see FIG. 2) of the box 1 (h2>h3). In other words, the lateral width h2 of the outer leg components 7Bb is larger than the depth h3 of the box 1 in a direction perpendicular to the bottom face 1*d* of the box 1. Thus, as shown in FIG. 2, each of the outer leg components 7Bb is disposed on a bottom face (e.g., bottom portion) 1*d* of the box 1, and extends upward and inward relative to respective one of side faces of the box 1. In other words, each of the outer leg components 7Bb slants relative to the respective one of the side faces of the box 1 in a direction apart from the respective one of the side faces of the box 1 as approaching upward to define a cushioning space having a triangular prism shape between each of the outer leg components 7Bb and the respective one of the side faces of the box 1.

As shown in FIG. 5, a pair of flaps 12 is provided integrally protruding outward from the side edges (e.g., side edge portions) of the central shelf component 7A relative to the side edges 7*a* of the cushioning material 7. When the flaps 12 are folded and the cushioning material 7 is inserted into the box 1, and the central shelf component 7A is pushed down, the lower edges (e.g., lower edge portions) 12*a* of the flaps 12 contact with the bottom face 1*d* that is closed off by the lower flaps 1*c* of the box 1 (see FIG. 3).

As shown in FIG. 5, the cushioning material 7 further includes two pairs of lateral extension slits 13, a pair of longitudinal fold lines (e.g., longitudinal fold portions) 14 and a pair of center tongues (e.g., upper tongue portions) 15. The lateral extension slits 13 are formed extending from the proximal ends of the lateral slits 8*b* toward the end edges 7*b* of the cushioning material 7 in the lateral direction of the cushioning material 7. The longitudinal fold lines 14 are parallel to the longitudinal slits 8*a*, and are formed between the distal ends of the two mutually opposing lateral extension slits 13. The center tongues 15 are formed in between the longitudinal fold lines 14 and the longitudinal slits 8*a*, and are folded around the longitudinal fold lines 14 so as to be opposite an upper face of the electronic device 4 (see FIG. 2).

As shown in FIG. 5, the cushioning material 7 further includes four pairs of longitudinal extension slits 17, four lateral fold lines 18 and four side tongues (e.g., two pairs of side tongue portions) 19. The longitudinal extension slits 17 are formed extending from the distal ends of the lateral extension slits 13 and the distal ends of the lateral slits 8*b* toward the side edges 7*a* of the cushioning material 7 in a longitudinal direction of the cushioning material 7 that is perpendicular to the lateral direction of the cushioning material 7. The lateral fold lines 18 are parallel to the lateral slits 8*b* and the lateral extension slits 13, and are formed in between the distal ends of the mutually opposing longitudinal extension slits 17. The side tongues 19 are formed in between the lateral fold lines 18 and the lateral slits 8*b* and lateral extension slits 13, and are folded around the lateral fold lines 18 so as to be opposite side faces of the electronic device 4 (see FIG. 1).

Figure 6:
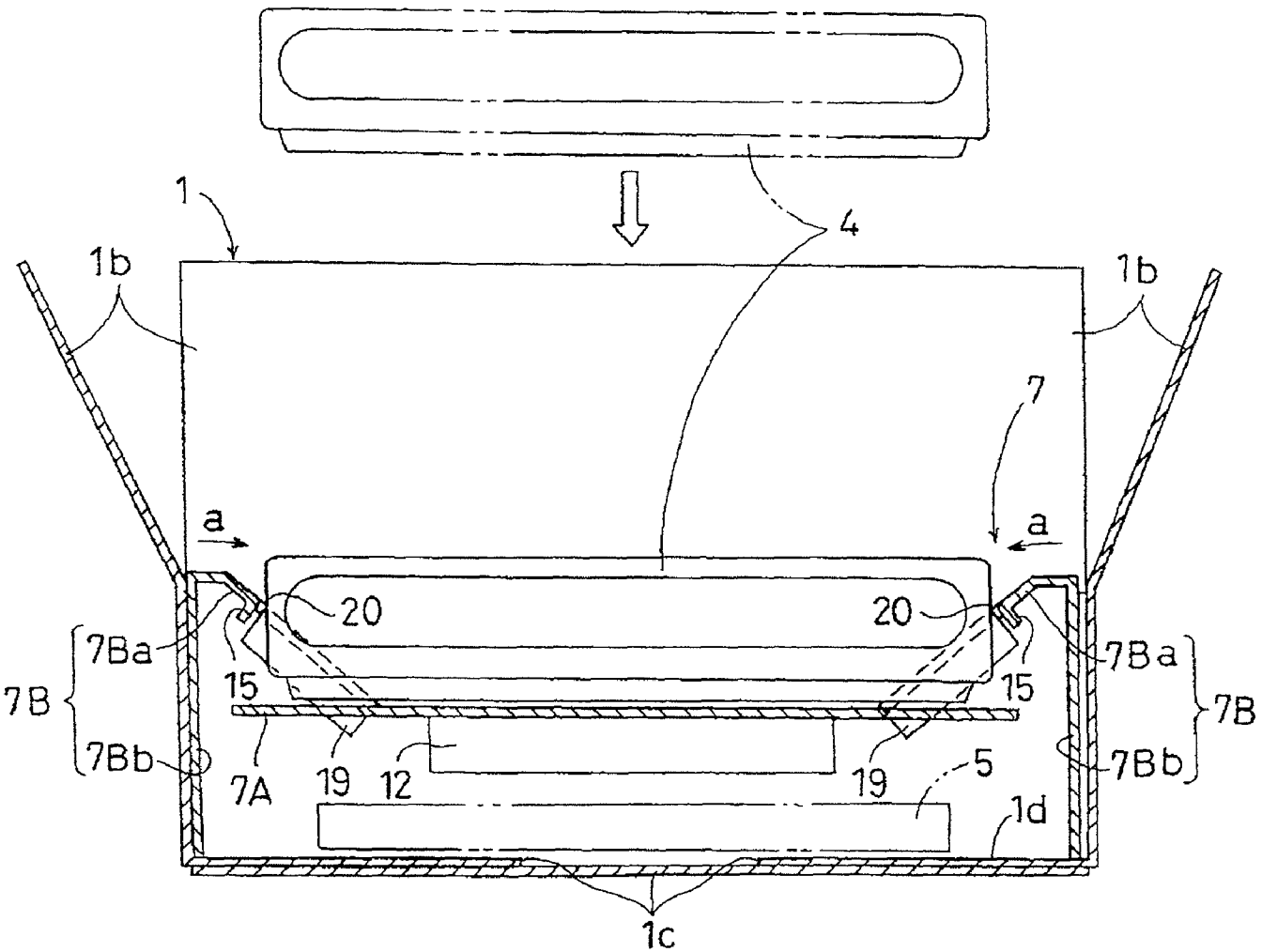
FIG. 6 is a cross sectional view illustrating an assembly procedure for the electronic device packaging apparatus illustrated in FIG. 1.

The assembly procedure will now be described. As shown in FIG. 6, the lower face opening of the box main body 1*a* is closed off by the lower flaps 1*c*, and the upper flaps 1*b* are spread upward to open up the upper opening of the box main body 1*a*. Then, an instruction booklet 5, a remote control (not shown), and so forth are placed on the bottom face 1*d* inside the box 1. Then, the flaps 12 are downwardly folded relative to the central shelf component 7A. Furthermore, the inner leg components 7Ba of the leg components 7B are upwardly folded around the inside fold lines 10 relative to the central shelf component 7A, and the outer leg components 7Bb of the leg components 7B are downwardly folded around the outside fold lines 9 relative to the inner leg components 7Ba. Then, the cushioning material 7 is inserted into the box main body 1*a* in this state. The electronic device 4 is put into the box main body 1*a* from above and placed on the central shelf component 7A (see the solid lines in FIG. 6), and the electronic device 4 is pressed to pushed down the central shelf component 7A, which tilts the outer leg components 7Bb in an inside direction of the arrow a toward the middle of the electronic device 4. Consequently, as shown in FIG. 2, upper end portions (e.g., upper edge portions) of the electronic device 4 contact with inner side faces of the outer leg components 7Bb through insertion holes (e.g., through holes) 20 made of the cut-outs 8 between the central shelf component 7A and the inner leg components 7Ba. Then, the upper face opening of the box main body 1*a* is closed off by the upper flaps 1*b*. Then, the upper flaps 1*b* contact with upper face portions between the outside fold lines 9 of the leg components 7B (between the inner leg components 7Ba and the outer leg components 7Bb).

The cushioning material 7 protects the electronic device 4, and is made of a single sheet of substantially rectangular cardboard. Thus, the number of sheets thereof is reduced in half compared to prior art, so the material cost can be lowered.

As shown in FIG. 6, in packaging the electronic device 4 in the box 1 via the cushioning material 7, the cushioning material 7 is merely inserted into the box 1 in a state in which the leg components 7B of the cushioning material 7 have been folded around the outside fold lines 9 and the inside fold lines 10. Then, the electronic device 4 is placed on the central shelf component 7A of the cushioning material 7, and the central shelf component 7A is pushed down, allowing the packaging work to be accomplished easily and quickly.

As shown in FIGS. 2 and 5, since the lateral width h1 of the inner leg components 7Ba is set smaller than the lateral width h2 of the outer leg components 7Bb, the electronic device 4 can be suspended in air merely by placing the electronic device 4 on the central shelf component 7A and pushing down the central shelf component 7A.

As shown in FIGS. 2 and 5, the lateral width h2 of the outer leg components 7Bb is set greater than the depth h3 of the box 1, the outer leg components 7Bb are fixed in a slanted state within the box 1. Furthermore, the upper end portions of the electronic device 4 hit the inner side faces of the outer leg components 7Bb in the slanted state, so the suspended state of the electronic device 4 can be effectively maintained.

Figure 3:
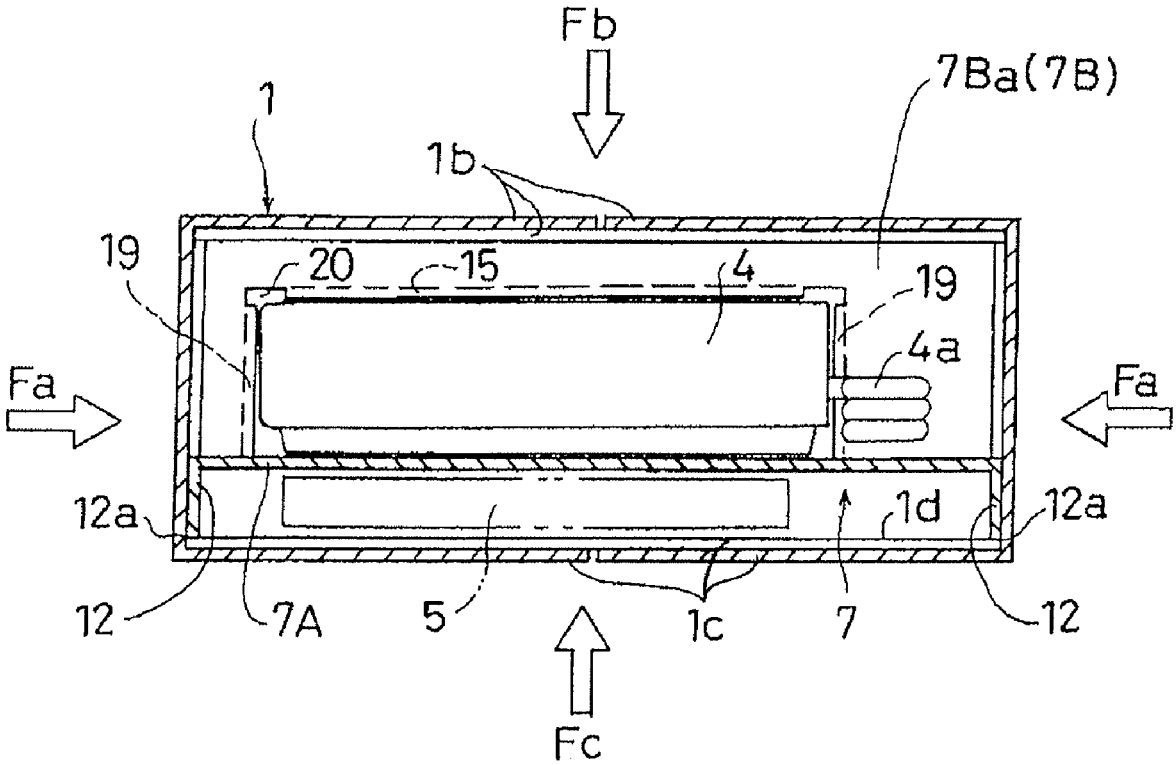
FIG. 3 is a cross sectional view of the electronic device packaging apparatus taken along line in FIG. 1.
Figure 4:
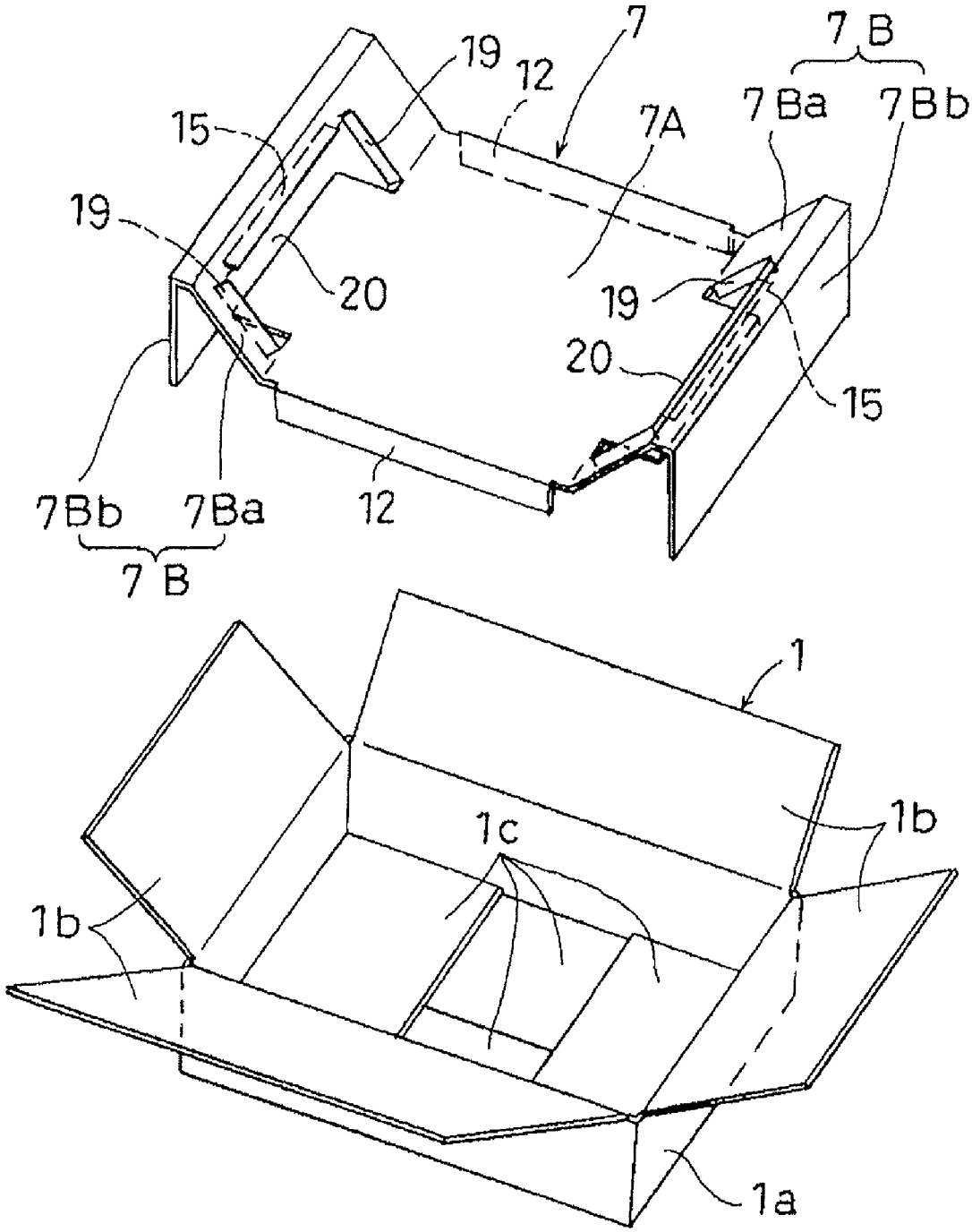
FIG. 4 is an exploded perspective view of the electronic device packaging apparatus illustrated in FIG. 1.

As shown in FIGS. 2 and 3, the electronic device 4 is suspended in air (at spaced apart location from the bottom face 1*d* of the box 1). Thus, there is plenty of space above, below, and to the sides of the electronic device 4 between the electronic device 4 and the box 1. Furthermore, the cushioning material 7 is interposed elastically deformably in the space. Thus, horizontal, downward, and upward impact forces Fa, Fb and Fc exerted on the side, upper, and lower faces of the box 1 are adequately cushioned, and the electronic device 4 can be protected.

As shown in FIG. 3, the lower edges 12*a* of the flaps 12 folded from the central shelf component 7A contact with the bottom face 1*d* of the box 1. Thus, the central shelf component 7A is prevented from sagging or bending under the weight of the electronic device 4, which allows the suspended state of the electronic device 4 to be effectively maintained.

As shown in FIG. 2, the center tongues 15 folded from the inner leg components 7Ba are opposite the upper face of the electronic device 4. Thus, even if the upper impact force Fc is exerted on the box 1, the upper impact force Fc exerted on the upper face of the electronic device 4 via the center tongues 15 can be cushioned even more effectively.

Figure 1:
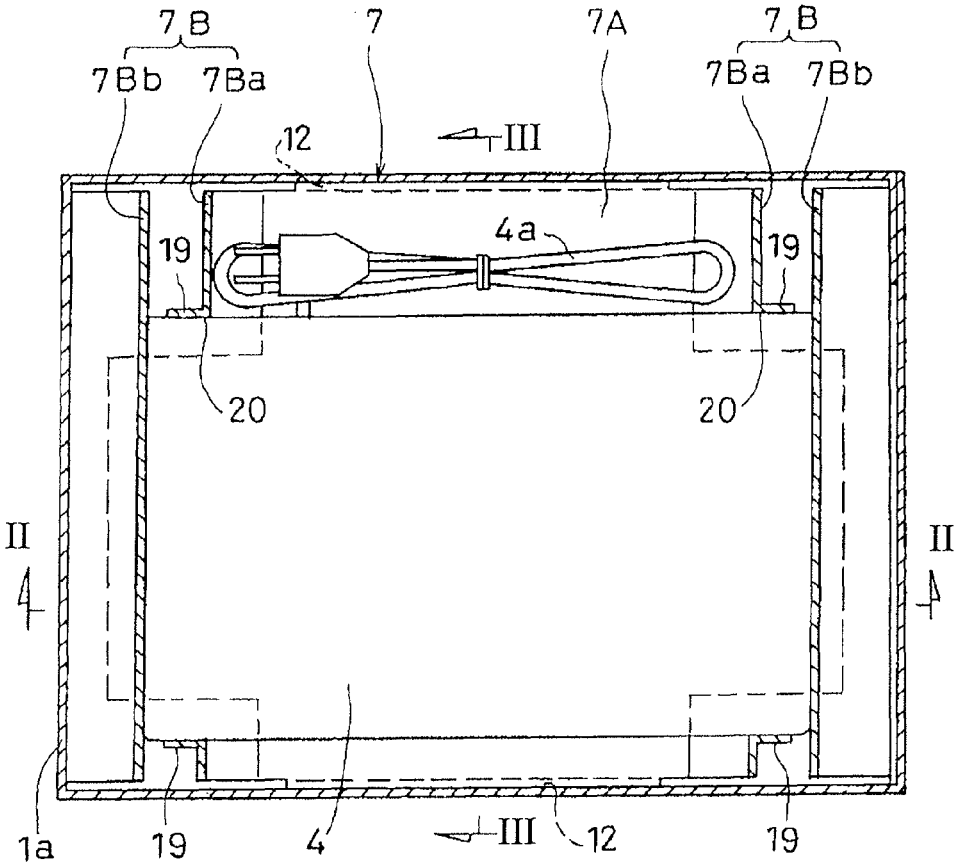
FIG. 1 is a cross sectional view of an electronic device packaging apparatus in accordance with one embodiment of the present invention.

As shown in FIG. 1, the side tongues 19 folded from the inner leg components 7Ba are opposite the side faces of the electronic device 4. Thus, even if the horizontal impact force Fa is exerted on the box 1, the horizontal impact force Fa exerted on the side faces of the electronic device 4 via the side tongues 19 can be cushioned even more effectively.

The electronic device packaging apparatus for packaging the electronic device 4 includes the box 1 and the cushioning material 7. The cushioning material 7 is integrally formed as a one-piece, unitary member and disposed within the box 1. The cushioning material 7 includes the central shelf component 7A and the leg components 7B. The central shelf component 7A supports the electronic device 4 relative to the box 1 at a spaced apart location above the bottom face 1*d* of the box 1. The leg components 7B support the central shelf component 7A relative to the box 1 therebetween. Each of the leg components 7B has the outer leg component 7Bb and the inner leg component 7Ba. The outer leg component 7Bb is placed on the bottom face 1*d* of the box 1 and extends upward and inward of the box 1 relative to respective one of side faces of the box 1. The lateral width h2 of the outer leg components 7Bb is larger than the depth h3 of the box. The inner leg component 7Ba with the through insertion hole 20 extends between the outer leg component 7Bb and the central shelf component 7A. The lateral width h1 of the inner leg components 7Ba is smaller than the lateral width h2 of the outer leg components 7Bb. The inner leg components 7Ba suspend the central shelf component 7A relative to the bottom face 1*d* of the box 1 therebetween. The inner side faces of the outer leg components 7Bb contact with the upper end portions of the electronic device 4, respectively, when the electronic device 4 is placed on the central shelf component 7A and the upper end portions of the electronic device 4 are disposed through the through insertion holes of the inner leg components 7Ba.

With the electronic device packaging apparatus, the inner leg components 7Ba are connected to the central shelf component 7A via the inside fold lines 10, respectively, and the outer leg components 7Bb are connected to the inner leg components 7Ba via the outside fold lines 9, respectively.

With the electronic device packaging apparatus, the cushioning material 7 further includes the flaps 12 that are integrally formed with the side edges of the central shelf component 7A. The flaps 12 extend downward from the side edges of the central shelf component 7A relative to the central shelf component 7A. The lower edges 12*a* of the flaps 12 contact with the bottom face 1*d* of the box 1.

With the electronic device packaging apparatus, each of the inner leg components 7Ba further includes the center tongue 15 that extends toward respective one of the outer leg components 7Bb from an upper edge portion of the insertion hole 20 of each of the inner leg components 7Ba. The center tongues 15 are disposed opposite the upper face of the electronic device 4 when the electronic device 4 is placed on the central shelf component 7A.

With the electronic device packaging apparatus, each of the inner leg components 7Ba further includes the side tongues 19 that extend toward respective one of the outer leg components 7Bb from side edge portions of the insertion hole 20 of each of the inner leg components 7Ba. The side tongues 19 are disposed opposite the side faces of the electronic device 4 when the electronic device 4 is placed on the central shelf component 7A.

With the electronic device packaging method for packaging the electronic device 4 in the box 1, the cut-outs 8 is formed on a single sheet of the cushioning material 7. Each of the cut-outs 8 includes the longitudinal slit 8*a* that extends perpendicular to a lengthwise direction of the cushioning material 7 and is formed near end portions of the cushioning material 7 and a pair of the lateral slits 8*b* that extends from both ends of the longitudinal slit 8*a* toward a center of the cushioning material 7. The inside fold lines 10 are formed on the cushioning material 7 to define the central shelf component 7A and the leg components 7B on the cushioning material 7. The leg components 7B extend upward from the central shelf component 7A via the inside fold lines 10. The inside fold lines 10 extend between distal ends of the longitudinal slits 8*a* and side edges 7*a* of the cushioning material 7. The outside fold lines 9 are formed on the leg components 7B of the cushioning material 7 to define the inner leg component 7Ba and the outer leg component 7Bb on the leg components 7B. The outer leg components 7Bb extend downward from the inner leg components 7Ba via the outside fold lines 9, respectively. The outside fold lines 9 are parallel to the longitudinal slits 8*a* of the cut-outs 8. The lateral width h1 of the inner leg components 7Ba is smaller than the lateral width h2 of the outer leg components 7Bb. The lateral width h2 of the outer leg components 7Bb is larger than the depth h3 of the box 1. The cushioning material 7 is inserted into the box 1 in a state in which the cushioning material 7 has been folded at the inside and outside fold lines 9 and 10. The electronic device 4 is placed on the central shelf component 7A of the cushioning material 7. The central shelf component 7A is pushed downward until upper edge portions of the electronic device 4 pass through the insertion holes 20 formed on the inner leg components 7Ba and contact with inner side faces of the outer leg components 7Bb.

With the electronic device packaging method, the flaps 12 that extend from side edges of the central shelf component 7A are folded before inserting the cushioning material 7 into the box 1. Furthermore, the central shelf component 7A is pushed downward until the lower edges 12*a* of the flaps 12 contact with the bottom face 1*d* of the box 1.

With the electronic device packaging method, the lateral extension slits 13 that extend from the proximal ends of the lateral slits 8*b* toward the end edges 7*b* of the cushioning material 7, respectively, are formed. Furthermore, the longitudinal fold lines 14 that extend between the distal ends of the lateral extension slits 13 are formed to define the center tongues 15 on the inner leg components 7Ba. The longitudinal fold lines 14 are parallel to the longitudinal slits 8*a* of the cut-outs 8. The center tongues are disposed opposite the upper face of the electronic device 4.

With the electronic device packaging method, the longitudinal extension slits 17 that extend from the distal ends of the lateral extension slits 13 and the distal ends of the lateral slits 8*b* toward the side edges 7*a* of the cushioning material 7, respectively, are formed. Furthermore, the lateral fold lines 18 that extend between the distal ends of the longitudinal extension slits 17 are formed to define the side tongues 19 on the inner leg components 7Ba. The lateral fold lines 18 are parallel to the lateral slits 8*b* and the lateral extension slits 13. The side tongues 19 are disposed opposite the side faces of the electronic device 4.

GENERAL INTERPRETATION OF TERMS

In understanding the scope of the present invention, the term "comprising" and its derivatives, as used herein, are intended to be open ended terms that specify the presence of the stated features, elements, components and groups, but do not exclude the presence of other unstated features, elements, components and groups. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an electronic device packaging apparatus equipped with the present invention. Accordingly, these terms, as utilized to describe the present invention should be interpreted relative to an electronic device packaging apparatus equipped with the present invention as used in the normal operating position.

While a preferred embodiment has been chosen to illustrate the present invention, it will be apparent to those skilled in the art from these disclosures that various changes and modifications can be made herein without departing from the scope of the invention as defined in the appended claims. Furthermore, the foregoing descriptions of the preferred embodiment according to the present invention are provided for illustration only, and not for the purpose of limiting the invention as defined by the appended claims and their equivalents.

What is claimed is:

1. An electronic device packaging apparatus for packaging an electronic device, comprising:

a box; and a cushioning member integrally formed as a one-piece, unitary member and disposed within the box, the cushioning member including a central shelf component that is configured to support the electronic device relative to the box at a spaced apart location from a bottom portion of the box, and a pair of leg components that supports the central shelf component relative to the box therebetween, each of the leg components having an outer leg component that is disposed on the bottom portion of the box and extends upward and inward of the box relative to respective one of side faces of the box, a lateral width of the outer leg components being larger than a depth of the box, and an inner leg component with a through hole that extends between the outer leg component and the central shelf component, a lateral width of the inner leg components being smaller than the lateral width of the outer leg components, the inner leg components suspending the central shelf component relative to the bottom portion of the box therebetween, inner side faces of the outer leg components contacting with upper edge portions of the electronic device, respectively, when the electronic device is placed on the central shelf component and the upper edge portions of the electronic device are disposed through the through holes of the inner leg components.

2. The electronic device packaging apparatus according to claim 1, wherein the inner leg components are connected to the central shelf component via inside fold portions, respectively, and the outer leg components are connected to the inner leg components via outside fold portions, respectively.

3. The electronic device packaging apparatus according to claim 1, wherein the cushioning member further includes a pair of flaps that is integrally formed with side edge portions of the central shelf component, the flaps extending downward from the side edge portions of the central shelf component relative to the central shelf component, with lower edge portions of the flaps contacting with the bottom portion of the box.

4. The electronic device packaging apparatus according to claim 1, wherein each of the inner leg components further includes an upper tongue portion that extends toward respective one of the outer leg components from an upper edge portion of the through hole of each of the inner leg components, with the upper tongue portions being disposed opposite an upper face of the electronic device when the electronic device is placed on the central shelf component.

5. The electronic device packaging apparatus according to claim 4, wherein each of the inner leg components further includes a pair of side tongue portions that extend toward respective one of the outer leg components from side edge portions of the through hole of each of the inner leg components, with the side tongue portions being disposed opposite side faces of the electronic device when the electronic device is placed on the central shelf component.

6. The electronic device packaging apparatus according to claim 3, wherein each of the inner leg components further includes an upper tongue portion that extends toward respective one of the outer leg components from an upper edge portion of the through hole of each of the inner leg components, with the upper tongue portions being disposed opposite an upper face of the electronic device when the electronic device is placed on the central shelf component.

7. The electronic device packaging apparatus according to claim 6, wherein each of the inner leg components further includes a pair of side tongue portions that extend toward respective one of the outer leg components from side edge portions of the through hole of each of the inner leg components, with the side tongue portions being disposed opposite side faces of the electronic device when the electronic device is placed on the central shelf component.

8. An electronic device packaging method for packaging an electronic device in a box, comprising:

forming a pair of substantially U-shaped cut-outs on a single sheet of cardboard, each of the U-shaped cut-outs including a longitudinal slit that extends perpendicular to a lengthwise direction of the cardboard and is formed near end portions of the cardboard and a pair of lateral slits that extends from both ends of the longitudinal slit toward a center of the cardboard, respectively;

forming a plurality of inside fold portions on the cardboard to define a central shelf component and a pair of leg components on the cardboard, the leg components extending upward from the central shelf component via the inside fold portions, the inside fold portions extending between distal ends of the longitudinal slits and side edges of the cardboard;

forming a plurality of outside fold portions on the leg components of the cardboard to define inner and outer leg components on the leg components, the outer leg components extending downward from the inner leg components via the outside fold portions, respectively, the outside fold portions being parallel to the longitudinal slits of the U-shaped cut-outs, a lateral width of the inner leg components being smaller than a lateral width of the outer leg components, the lateral width of the outer leg components being larger than a depth of the box;

inserting the cardboard into the box in a state in which the cardboard has been folded at the inside and outside fold portions;

placing the electronic device on the central shelf component of the cardboard; and pushing the central shelf component downward until upper edge portions of the electronic device pass through holes formed on the inner leg components and contact with inner side faces of the outer leg components.

9. The electronic device packaging method according to claim 8, further comprising folding a pair of flaps that extends from side edges of the central shelf component before the inserting of the cardboard into the box, the pushing of the central shelf component downward further including pushing the central shelf component downward until lower edges of the flaps contact with a bottom portion of the box.

10. The electronic device packaging method according to claim 8, further comprising forming a plurality of lateral extension slits that extends from proximal ends of the lateral slits toward lateral side edges of the cardboard, respectively, and forming a pair of longitudinal fold portions that extends between distal ends of the lateral extension slits to define a pair of upper tongue portions on the inner leg components, the longitudinal fold portions being parallel to the longitudinal slits of the U-shaped cut-outs, the upper tongue portions being disposed opposite an upper face of the electronic device.

11. The electronic device packaging method according to claim 10, further comprising forming a plurality of longitudinal extension slits that extends from the distal ends of the lateral extension slits and distal ends of the lateral slits toward the side edges of the cardboard, respectively, and forming a plurality of lateral fold portions that extends between distal ends of the longitudinal extension slits to define a plurality of side tongue portions on the inner leg components, the lateral fold portions being parallel to the lateral slits and the lateral extension slits, the side tongue portions being disposed opposite side faces of the electronic device.

12. The electronic device packaging method according to claim 9, further comprising forming a plurality of lateral extension slits that extends from proximal ends of the lateral slits toward lateral side edges of the cardboard, respectively, and forming a pair of longitudinal fold portions that extends between distal ends of the lateral extension slits to define a pair of upper tongue portions on the inner leg components, the longitudinal fold portions being parallel to the longitudinal slits of the U-shaped cut-outs, the upper tongue portions being disposed opposite an upper face of the electronic device.

13. The electronic device packaging method according to claim 12, further comprising forming a plurality of longitudinal extension slits that extends from the distal ends of the lateral extension slits and distal ends of the lateral slits toward the side edges of the cardboard, respectively, and forming a plurality of lateral fold portions that extends between distal ends of the longitudinal extension slits to define a plurality of side tongue portions on the inner leg components, the lateral fold portions being parallel to the lateral slits and the lateral extension slits, the side tongue portions being disposed opposite side faces of the electronic device.

* * * * *